United States Patent [19]

Alefeld

[11] Patent Number: 4,474,025

[45] Date of Patent: Oct. 2, 1984

[54] HEAT PUMP

[76] Inventor: Georg Alefeld, Josef-Raps-Strasse 3, Munich, Fed. Rep. of Germany

[21] Appl. No.: 399,736

[22] Filed: Jul. 19, 1982

[51] Int. Cl.[3] ..... F25B 15/00

[52] U.S. Cl. ..... 62/148; 62/238.3; 62/238.4; 62/335; 62/476

[58] Field of Search ..... 62/148, 476, 335, 238.3, 62/238.4, 238.6

[56] References Cited

U.S. PATENT DOCUMENTS

| | | | |
|---|---|---|---|
| 3,392,541 | 7/1968 | Nussbaum | 62/335 X |
| 3,824,804 | 7/1974 | Sandmark | 62/238.3 |
| 4,100,755 | 7/1978 | Leonard | 62/148 X |
| 4,301,662 | 11/1981 | Whitnah | 62/238.4 |

*Primary Examiner*—Lloyd L. King

*Attorney, Agent, or Firm*—Frishauf, Holtz, Goodman & Woodward

[57] ABSTRACT

A heat pump for heating and/or refrigeration comprises a combination of a working fluid circuit including a steam ejector or a heat operated piston heat pump device and absorption heat pump section. The first circuit is energized with relatively high-grade, input heat and produces lower-grade output heat. The output heat energizes the absorption heat pump section. The combination provides for efficient use of the available energy (exergy) of the input heat.

6 Claims, 13 Drawing Figures

HEAT PUMP

The present invention relates to the utilization of heat by means of processes which involve both absorption and desorption of a refrigerant or, more generally, a working fluid, in an absorbent, and compressing a working fluid by a heat energized gas compressing apparatus.

The prior art

The use of a steam ejector as an industrial heat pump is known:

H. G. Arnold et al "The Steam Ejector as an industrial heat pump", ASHRAE TRANSACTIONS, 1982, V. 88, Pt. 1;

Richard M. Hamner, "An Alternate Source of Cooling: the Ejector-Compression Heat Pump", ASHRAE JOURNAL, July 1980, 62 to 66;

U.S. Pat. No. 4,007,776 (Alkasab),

German Auslegeschrift 22 16 204 (Kuhlenschmidt, based on U.S. Application Ser. No. 130,659, filed Apr., 2, 1971, now abandoned).

Further, multi-stage heat pumps have been proposed in an U.S. patent application based on international application PCT/EP 82/0063, International Filing Date: 24th March, 1982, incorporated by reference.

The use of the Vuilleumier cycle (U.S. Pat. No. 1,275,507 of 13th Aug., 1918) in close-cycle refrigeration is known from:

G. Prast "The Vuilleumier Cycle", published in "Cryogenics and Infrarot Detection" Proc. of Technical Colloquium, Boston Technical Publisher, April 1969.

G. K. Pitcher "Energy Conversion by a Vuilleumier Cycle Engine/Refrigerator" Intersociety Energy Conversion Engineering Conference.

Other heat-driven heat pumps operate on the principle of the Rankine/Rankine cycle or the Stirling-Stirling cycle, or the Obsterling-Rankine cycle. Such systems are disclosed in the "PAPERS PRESENTED AT THE INTERNATIONAL SYMPOSIUM ON THE INDUSTRIAL APPLICATION OF HEAT PUMPS", 24–26 March, 1982, Coventry, England, published by B.H.R.A. Fluid Engineering, Cranfield, Bedford, UK. See specifically:

D. Vokaer et al "Heat-driven free piston heat pump" 1. c. page 1;

G. Walker et al "Stirling engine heat pumps", 1. c. page 9.

THE INVENTION

The term "Heat Pump" is used throughout in the specification both for systems intended mainly for refrigeration purposes and for systems intended mainly for heating purposes, as well as for systems serving both of said purposes simultaneously or alternatively.

The efficiency of the known absorption heat pumps is impaired by the temperature limit posed by the working fluid/absorbent systems. A typical example is the $LiBr/H_2O$-machine which cannot use temperatures much above 150 degrees centigrade because of corrosion problems. Further, some working fluid/absorbent systems suffer from decomposition at elevated temperatures which would be desirable for making the best use of the availability (exergy) of the input heat.

Thus, a main object of the invention is to provide a heat pump which makes better use of the input heat than the known heat pumps.

It is further an object of the invention to provide a $LiBr/H_2O$ or $NH_3/H_2O$ machine of improved efficiency.

A still further object of the invention is to provide a heat pump which uses heat of elevated temperature to reduce the exergy i.e. available energy losses.

Still another object of the invention is to avoid or appreciably reduce the corrosion and decomposition problems which are otherwise encountered in heat pumps utilizing input heat at elevated temperatures.

These and other objects are attained by the heat pumps according to the invention which includes a section, in which high temperature heat is used to change the pressure of a working fluid or supply velocity to a circulating working fluid, and at least one further section which operates on the principle of an absorption heat pump. The high level "primary" input heat is used to furnish the availability, by which the working fluid is acted upon in the first stage, and the upgraded ("pumped") heat as well as the "waste" heat of the first stage is used as "secondary" input heat to drive the absorption heat pump section.

The first section preferably comprises a steam generator and ejector system. Alternatively, the first section may comprise a turbine-compressor combination. Other alternatives of useful heat-energized non-absorption heat pumps are the Vuilleumier cycle machine, the Rankine-Rankine cycle machine, the Stirling-Stirling cycle machine and the Stirling-Rankine cycle machine.

Since the high temperature first section of the present systems operates with pure working fluid, as $H_2O$, Helium, and other fluids, the problem of corrosion and decomposition is minimized or completely avoided. Thus, relatively high level input heat can be utilized to improve the overall efficiency.

The invention can be used with great advantage to update existing installations comprising absorption heat pump systems since the high-temperature stage generally can be hooked up on the existing system with minor modifications thereof.

The type of diagrammatic representation of the components of an absorption heat-pump and their connections, as used in FIGS. 1A, 2, 3A, and 4 to 8 is known to those skilled in the art, and explained e.g. in the International Application based United States patent application mentioned above. In short, the main components performing the absorption cycle, namely generator, condenser, evaporator, and absorber are represented by small circles, and the fluid connections between those components are represented by single lines. (Crossing lines do not connect). All secondary components, as heat exchangers, absorbent circuits, pressure reducing devices, absorbent pumps, bypass conduits, valves and so on, which are generally present in such systems, as well known in the art, are omitted from these diagrammatic representations for the sake of clarity. The main components mentioned above, for which the general term "exchange unit" will be used in the following specification and claims, are represented in a ln p/(-1/T) diagram at places, from which the relative pressure and temperature ranges can be derived in which the respective components operate. This does not apply to components, as steam ejectors, turbine-compressor combinations, and Vuilleumier machines and so on, used in a first, high temperature stage of the present heat pumps.

It is assumed in the following description of the embodiments of the invention that the working fluid system comprises $H_2O$ as working fluid and an aqueous lithium bromide solution as absorbent. This system is well known and widely used. Of course, the invention is not limited to this system.

Figure 1A:
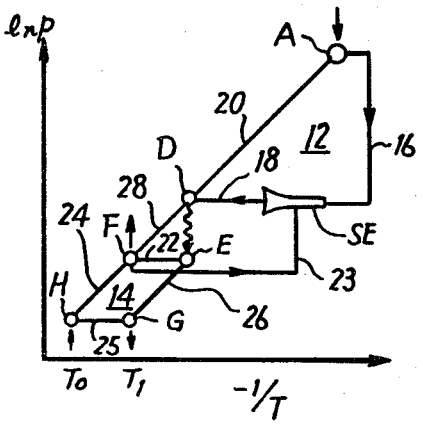
FIG. 1A and 1B are a diagrammatic and a schematic view, respectively, of a preferred embodiment of a two-stage heat pump constructed in accordance with the principles of the present invention.

The preferred embodiment of the invention diagrammatically shown in FIG. 1A comprises a first, high-temperature section 12 which includes an evaporator A, a steam ejector SE, and a condenser D. Further, the heat pump system of FIG. 1A comprises a low temperature section 14 including a generator E, a condenser F, an absorber G, and an evaporator H.

The evaporator A is connected by a steam line 16 to the driving fluid input of the ejector SE which has its output line 18 connected to condenser D. Condenser D is coupled through a feed line 20 which comprises a feed pump, not shown in FIG. 1A to evaporator A.

The generator E of the low temperature section is connected by line 22 carrying evaporated working fluid to condenser F which is connected by line 24 carrying condensed, liquid working fluid and comprising a pressure reducing device, not shown, to evaporator H. Evaporator H is connected by line 25 carrying evaporated gaseous working fluid, to absorber G which in turn is connected by an absorbent circuit 26 to generator E. The absorbent circuit 26 generally comprises a first conduit including a pump to carry rich absorbent, and a second conduit comprising a pressure reducing or throttle device, and carrying poor absorbent, the terms "rich" and "poor" relating to the proportion of absorbed working fluid.

Exchange units, D, and F are coupled by a fluid line 28, and exchange units D, and E are arranged in heat-exchange relationship symbolized by a wavy arrow.

The general operation of the system shown in FIG. 1A is as follows: High-grade heat at a temperature level of e.g. 220 to 250 degrees centigrade, or above is applied to evaporator A which comprises pure working fluid, i.e. water, and produces steam at a pressure of e.g. 20 to 40 bar to the drive input of ejector SE. The suction input of ejector SE is coupled to condenser F by line 23. The output fluid of the ejector is condensed in condenser D, and the condensation heat is used in generator E to drive the working fluid out of the rich solution received from absorber G. A first portion of the water condensed in D is fed by the feeding water pump in line 20 to evaporator A, the other portion flows through line 28, comprising a pressure reducing device, to condenser F.

The condenser F will comprise working fluid in the liquid state and working fluid in the vapor state since gaseous working fluid is supplied from the generator E, and part of the liquid working fluid from condenser D will evaporate when the pressure is reduced to the level in condenser F. The suction input of ejector ST will receive vapor of lower temperature than that of the vapor generated in E.

The low-pressure, low temperature section 14 operates in the well-known manner of an absorption heat pump delivering heat at a temperature level $T_1$ from F, and G, and receiving heat at a temperature level $T_O$ which, depending on the application of the system, may be low-grade heat available from the environment or an industrial process, or heat removed for the purpose of refrigeration.

The input line 23 of the ejector SE may be coupled to generator E instead to condenser F if the pressure drop to condenser F is objectionable.. However, generally the connection shown in FIG. 1A is preferred, because the working fluid evaporated in E is cooled down in F before it flows to the suction input line 23 of the ejector.

Figure 1B:
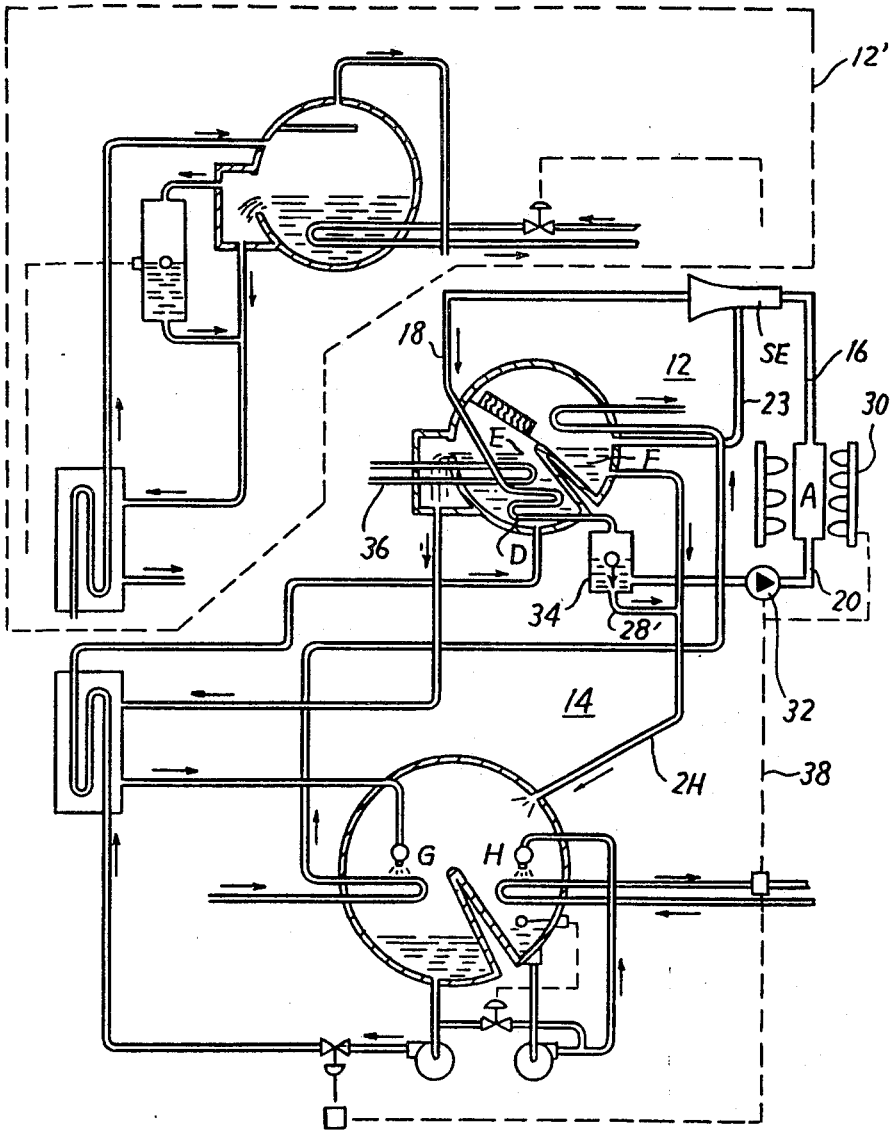

FIG. 1B is a schematic view of a practical embodiment of a system of the type described with reference to FIG. 1A. Same elements bear the same reference numbers. The system shown in FIG. 1B is derived from a known system disclosed in German Auslegeschrift 21 36 408 by replacing a high-temperature absorption cycle stage 12' of the known system by a high-temperature section 12 comprising a steam ejector SE. The evaporator A is a boiler provided with a heating device 30 e.g. a gas burner, the input line 20 comprises the feeding water pump 32. Condenser D is connected through an intermediate storage vessel 34 to which the inlet of line 20 connects, to evaporator H, and the liquid exit of vessel 34 is coupled to line 24 connecting condenser F to evaporator H. FIG. 1B differs from FIG. 1A in that line 28' connects condenser D to evaporator H rather than to condenser F as line 28 does in FIG. 1A.

The heat transfer from D to E is provided for by forming D as a heat-exchanger element within E, as shown.

Generator E may be provided with an additional heat input element 36 adapted to be connected to a realtively low temperature heat source, e.g. to receive solar heat or heat comprised in the flue gas of burner 30.

The output of the system can be controlled by carrying the throughput of pump 32, and the heat supplied to evaporator A, and/or by the heat input to evaporator H as schematically shown by dashed line 38.

The operating temperature of boiler A is not limited by corrosion problems or the stability of an absorbent within E, as shown.

The output of the system can be controlled by varying the throughput of pump 32, and the heat supplied to evaporator A, and/or by the heat input to evaporator H as schematically shown by dashed line 38.

In normal use, when the steam ejector SE is in operation, the absorption heat pump comprising the exchange units E, F, G, H is energized by heat supplied from the compression heat pump section including the exchange units A, D, F, and the ejector SE, said heat including heat upgraded by the heat-pump action, and the unused portion of the drive heat.

Figure 2:
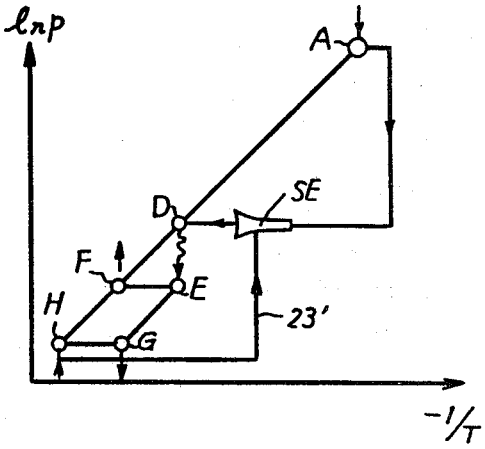
FIG. 2 is a diagrammatic view of a modification of the embodiment shown in FIGS. 1A, and 1B.

The system shown in FIG. 2 differs from that shown in FIG. 1A by the input line 23' being connected to evaporator H rather than to condensor F as in the case of FIG. 1A, and 1B.

Figure 3A:
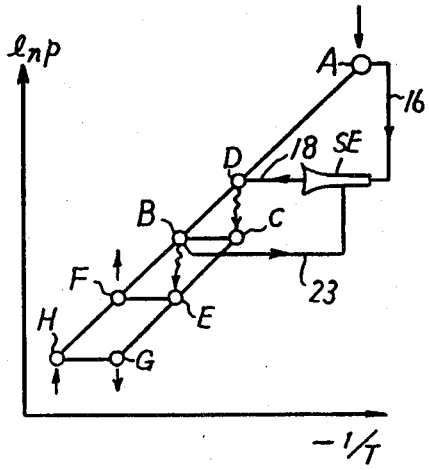
FIG. 3A and 3B are diagrammatic, and schematic views, respectively, of a second embodiment of the invention.
Figure 3B:
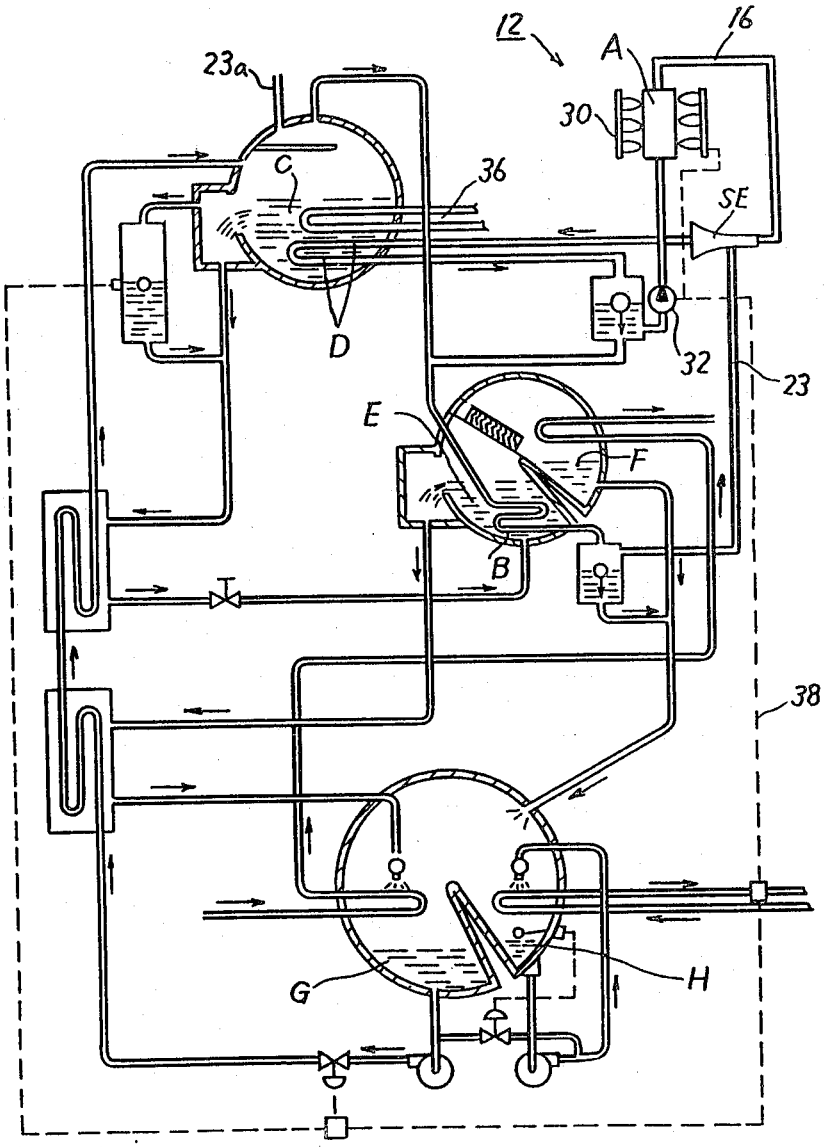

FIGS. 3A, and 3B show an embodiment of the invention which is derived from a known two-stage absorption heat pump by an additional steam ejector heat pump.

The embodiment shown in FIG. 3A and 3B differs from that shown in FIGS. 1A, and 1B by two additional exchange units B, C which form with the exchange units E, F, G, and H a two-stage absorption heat pump. The suction line 23 of ejector SE has its input connected to exchange unit B operating as a second condenser. Heat from first condenser D is coupled to generator C, and heat from the second condenser is coupled to exchange unit E operating as a second generator. If the pressure drop caused by B is objectionable, the suction line 23 may be connected to generator C as shown by connection 23*a*.

Figure 4:
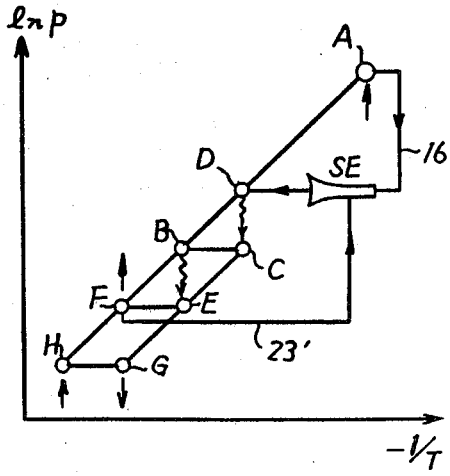
FIG. 4 is a diagrammatic view of a modification of the embodiment shown in FIGS. 3A and 3B.

The system shown in FIG. 4 differs from that shown in FIG. 3 in that the input of the suction line 23' is connected to unit F rather than to unit B as in the case of FIG. 3.

Figure 5:
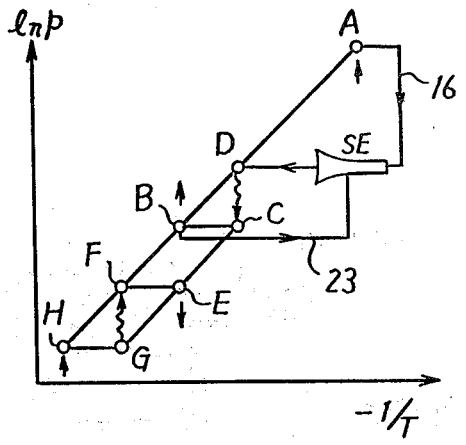
FIG. 5 is a diagrammatic view of a further modification of the embodiment shown in FIG. 1A.

The system shown in FIG. 5 differs from that shown in FIG. 3 in that heat is transferred from absorber G to exchange unit F, which operates as evaporator. E in this case is an absorber.

The systems shown in FIG. 1 and 3 have improved efficiencies compared with corresponding known $LiBr/H_2O$ absorption heat pumps.

The system of FIG. 5 has the advantage, that the difference between the low refrigeration heat input temperature at H, and the temperature of the heat rejected from B and E is relatively large.

Figure 6:
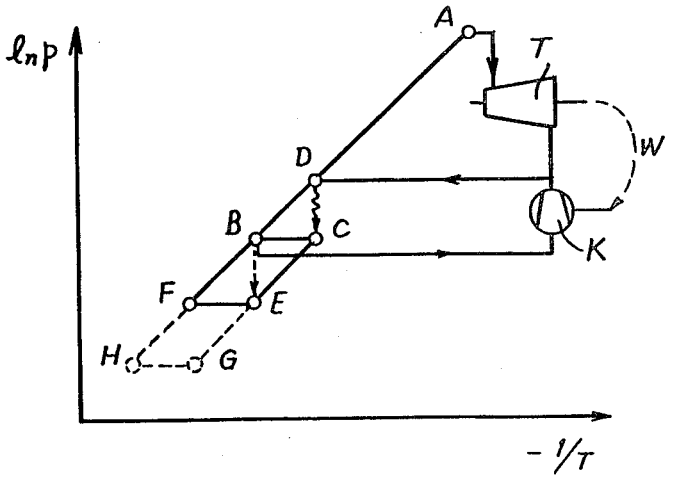
FIG. 6 is a diagrammatic view of an embodiment of the invention using a turbine-compressor combination.

The system shown in FIG. 6 (without the components H and G) is similar to that of FIG. 1 or (with the components G, H), to that of FIG. 3A the only difference being that a turbine T—compressor K aggregate is used instead of the steam ejector. Turbine T drives the compressor K by delivering mechanical energy W to the latter, and the heat comprised in the output fluids of the turbine and the compressor is utilized as described above.

In all of the above-described embodiments, the working fluid circuits of the compression heat pump section, and the absorption heat pump section communicate. This is, however, not necessary, the circuits may be separate, and coupled only to effect the heat transfer necessary for obtaining the benefits of the invention.

Figure 7:
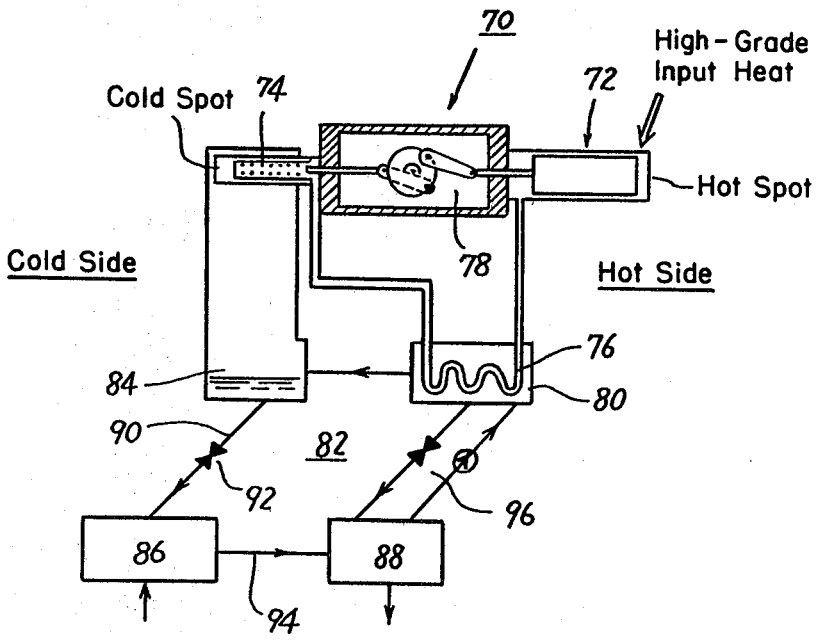
FIG. 7 is a diagrammatic view of an embodiment of the invention which comprises a modified Vuilleumier machine.

FIG. 7 shows a first type of embodiments of the invention, wherein the working fluid circuits of the high-temperature section, and of the absorption heat pump portion do not communicate as in the embodiments of FIGS. 1 to 6, rather these two portions of the heat pump shown in FIG. 7 are coupled only thermally.

The heat pump schematically shown in FIG. 7 comprises a Vuilleumier machine 70 as described by picture. Thus, this machine comprises two cylinders 72, 74, a heat exchanger 76, and a crank mechanism 78. The heat exchanger 76 is positioned within a generator unit 80 of an adsorption heat pump section 82. Section 82 is a single stage section and comprises a condenser 84 thermally coupled with the cold side of the Vuilleumier machine 70, an evaporator 86, and an absorber 88. The condensor 84 is coupled through a conduit 90, which comprises a pressure reducing device 92 to evaporator 86 which in turn is coupled to absorber 88 via a conduit 94. The absorber 88 is coupled to generator 80 by a conventional absorbent circuit comprising a conduit with a pump for the rich solution and a conduit with a pressure reducing device for the poor solution.

In operation, high-grade input heat is supplied to the hot side of the Vuilleumier machine, i.e. cylinder 72. The output heat of the Vuilleumier machine, which is waste heat, when the Vuilleumier machine is operated in conventional manner, is transferred through heat exchanger 76 to the generator 80 of the absorption heat pump section 82 to energize said heat pump section. The heat needed by the cold side of the Vuilleumier machine is furnished by the condensation heat generated in condenser 84 which is thermally coupled to the cylinder 74. The overall system of FIG. 7 produces "cold" at 86, and output heat of a relatively high level at 88. The absorption heat pump section may be constructed as disclosed with reference to units E, F, G, and H of FIG. 1B.

The system of FIG. 7 makes better use of the availability of the high-grade input heat than the known systems of comparable performance, because the output heat of the Vuilleumier machine is utilized in the absorption heat pump portion rather than being dumped to the invironment as in the prior art.

The cold side of the Vuilleumier machine 70 can alternatively be thermally coupled to 88 or both 88 and 84. As a still further alternative, the cold side 74 may be coupled to an external heat source, e.g. a solar collector.

The Vuilleumier machine may be replaced by a Stirling-Stirling machine or a Stirling-Rankine machine or a Rankine-Rankine machine.

Figure 8:
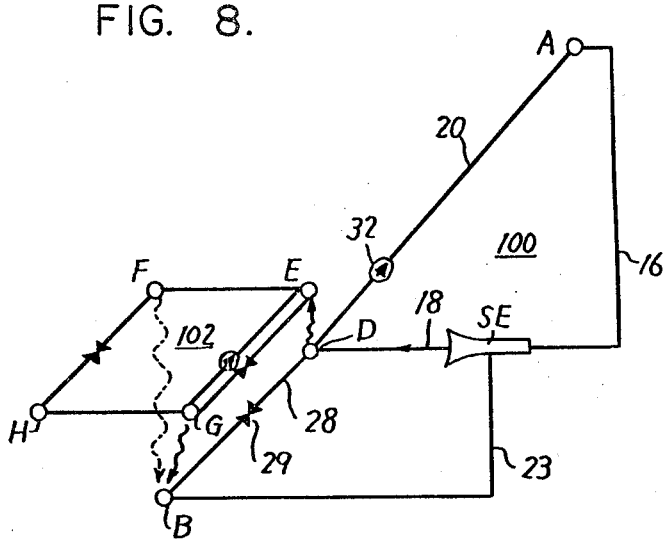
FIG. 8 is a diagrammatic view of an embodiment of the invention having two non-communicating working fluid circuits.

FIG. 8 is a diagrammatic representation of another embodiment of the type having separate working-fluid circuits. The system shown in FIG. 8 comprises a steam ejector heat pump portion 100 and an absorption heat pump portion 102. The working fluid circuits of said portions being separate, the portions being, however, thermally coupled so that the generator heat needed by portion 102 is furnished by portion 100, and the heat needed by portion 100 is furnished by portion 102.

The steam ejector heat pump portion 100 comprises a boiler A, a steam ejector SE, a condenser D, and an evaporator B. Boiler A receives input heat which may be of any desired, high temperature e.g. 200° to 250° C. since the boiler comprises only pure water. Boiler A is connected by steam line 16 to the drive input of the steam ejector SE, the output of which being coupled by output line 18 to condenser D. Condenser D is coupled through a water feeding line 20 comprising a feeding pump 32 to boiler A, and by a fluid line 28 comprising a pressure reducing device 29 to evaporator B which in turn is connected via suction line 23 to the suction input of steam ejector SE.

Portion 102 comprises a generator E, a condenser F, an absorber G, and an evaporator H connected in a conventional absorption heat pump circuit. Generator E is arranged to receive input heat from condenser D as symbolized by a wavy arrow. Evaporator B receives evaporation heat from absorber G and/or condenser F. The working fluid/absorbent system of portion 102 may be either $NH_3/H_2O$ or lithium bromide/methanole or R 22/E181.

As in the other embodiments, the temperature of the input heat supplied to boiler A can be high, and its availability can be better utilized as in known systems.

FIG. 9 to 12 show embodiments of the second type (non-communicating working fluid circuits), wherein the absorption heat pump portion has more than one stage.

Figure 9:
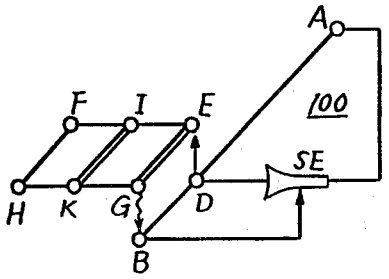
FIG. 9 to 12 are diagrammatic views of embodiments of the invention comprising two heat-coupled sections, the working fluid circuits of which do not communicate, and the absorption heat pump section comprising two stages.

Thus, the system diagrammatically shown in FIG. 9 can be derived from the system explained with reference to FIG. 8 by interposing two further exchange units I, K to form a two-stage absorption heat pump described in the above-mentioned United States application based on International Application Ser. No. PCT/EP 82/0063 with reference to FIG. 5*a*.

Figure 10:
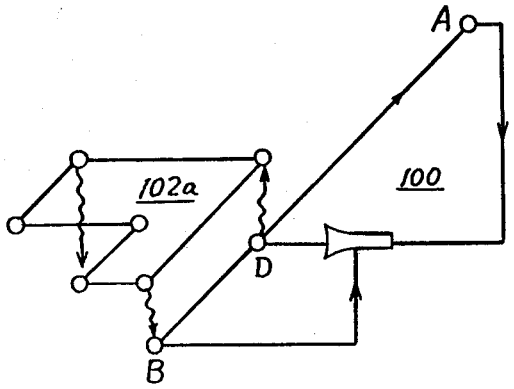

FIG. 10 shows an embodiment which is a combination of a steam ejector heat pump portion 100 with a two-stage absorption heat pump portion 102*a* similar to that described with reference to FIG. 18*c* of the International filed United States application.

Figure 11:
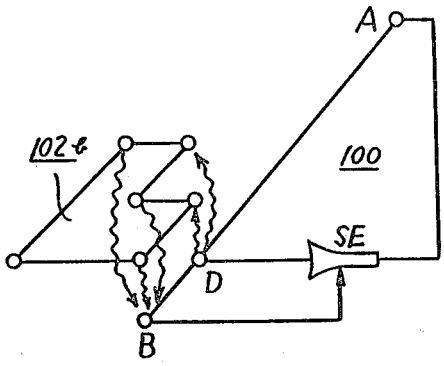

FIG. 11 is a combination of a steam ejector heat pump portion 100 with a two-stage absorption heat pump portion 102*b* which is similar to that described with reference to FIG. 18*d* of the international filed United States application mentioned above.

Figure 12:
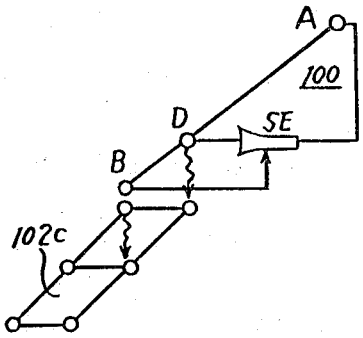

FIG. 12 is a combination of a steam ejector heat pump portion 100 with a two-stage absorption heat pump as described with reference to FIG. 5*b* of the international filed U.S.-application mentioned above. In each of the FIGS. 9 to 12, a heat coupling between two units is symbolized by a wavy arrow. The operation of the embodiments shown in FIGS. 8 to 12 should be evident when reading the above description and the International filed United States application mentioned.

The essential feature of the systems shown in FIGS. 8 to 12 is the thermal coupling between the condenser D of portion 100 to the main heat input stage of the absorption heat pump portion. It is, however, not necessary, although generally preferred, that the evaporator B of portion 100 receives heat from portion 102.

Figure 13:
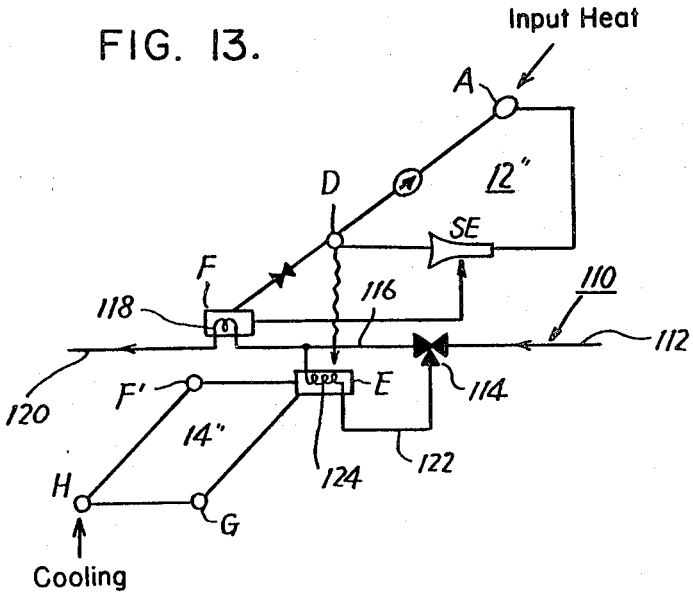
FIG. 13 is a diagrammatic view of an embodiment of the invention useful for utilizing solar and industrial process waste heat.

FIG. 13 shows an embodiment useful for utilizing solar heat or waste heat from an industrial process and the like. The system of FIG. 13 can be regarded as a modification of the system of FIG. 8. A steam ejector heat pump portion 12" comprises a steam generator (boiler) A, a steam ejector SE, a condenser D, an evaporator F. A heat pump portion 14" having a working fluid and absorbent circuit separated from that of portion 12", comprises a generator E thermally coupled to condenser D, a second condenser F', a second evaporator H, and an absorber G. Means 110 are provided to feed solar heat or waste heat from an industrial process to generator E, and/or first evaporator F; said means comprising an input line 112, a three-way valve 114, a conduit 116 connecting a first output of valve 114 to the input of a heat exchanger element 118 arranged to deliver heat to first evaporator F, an output line 120 which may return to solar collector (not shown) to close a heat transfer circuit with input line 112, and a further conduit 122 connecting a second output of valve 114 through a second heat exchanger element 124 to conduit 116. The second heat exchanger element 124 is arranged to deliver heat to generator E.

In operation, when the temperature of the heat carrying medium supplied through input line 110 is high, the system is operated with the absorption heat pump portion 14" alone. Thus, valve 114 is set to direct all of the heat carrying medium from input line 112 through heat exchanger element 124 to energize the absorption heat pump portion 14". The steam ejector heat pump portion 12" is shut down.

If the temperature of the heat carrying medium in line 112 is too low or the demand on cooling power available at H is too high, the steam ejector heat pump portion 12" is put in operation to furnish additional heat to energize generator E. The heat carrying medium from line 112 is still directed through heat exchanger element 124, and its remaining heat content is further utilized in evaporator F.

If the temperature of the heat carrying medium in input line 112 is still lower, the valve 114 is set to disconnect heat exchanger element 124, and pass the medium from input line 112 directly to heat exchanger element 118.

The system of FIG. 13 provides for a much better utilizing of the heat supplied via means 110 than comparable known systems.

The system of FIG. 13 can be modified by omitting valve 114, conduit 112, and heat exchanger element 124. A further modification is to use a two-stage absorption heat pump portion similar to portion 102*c* of FIG. 12, instead of the single stage absorption heat pump portion 14" of FIG. 13.

The system explained with reference to FIG. 13 can use lithium bromide/water in the absorption heat pump portion. The exchange units may operate at the following approximate temperature levels:

H: 5 degrees centigrade

Units F', and G:35 to 45 degrees centigrade

Unit E: 80 to 90 degrees centigrade.

The operation temperature of boiler A is not limited by corrosion problems or the stability of an absorbent since it is be operated with pure water.

I claim:

1. A heat pump system (FIG. 2) comprising a first evaporator (A) receiving input heat to produce relatively high pressure working fluid vapor;

compressor means (SE) having first and second input ports (16, 23) and an output port (18), said first input port coupled to said evaporator (A) to receive said vapor for driving said compressor means, said second input port being adapted to receive relative low pressure working fluid vapor to be compressed;

a first condensor (D) coupled to said outlet port of said compressor means to receive vapor from said outlet port to condense said vapor whereby heat of condensation and liquid working fluid is produced;

means (20) for returning condensed working fluid to said first evaporator (A);

said first evaporator (A), said compressor means (SE), said first condensor (D), and said return means (20) being connected in series to form a first working fluid loop;

a generator (E) comprising an absorbent for said working fluid and receiving input heat to expel working fluid vapor from absorbent relatively rich in working fluid to produce working fluid vapor and absorbent relatively depleted of working fluid;

a second condensor (F) coupled to receive said expelled working fluid vapor to condense it, whereby heat of condensation is produced;

pressure reducing means;

a second evaporator (H) receiving input heat and coupled to said second condensor (F) through said pressure reducing means to receive and evaporate said condensed working fluid;

an absorber (G) coupled to receive said evaporated working fluid vapor from said second evaporator, and said relatively depleted absorbent from said generator (E) to produce absorbent relatively rich in working fluid, and heat of absorption, and means to return said relatively rich absorbent to said generator; said generator, said second condensor, said pressure reducing means, said second evaporator, said absorber and said return means being connected in series to form a second working fluid loop, wherein said first condensor (D) and said generator (E) are thermally coupled to supply said heat of condensation from said first condensor as input heat to said generator, a working fluid connection (23) between said second evaporator (H), and said low pressure inlet of said compressor means, and a second working fluid connection (28) between said first (D) and second (F) condensors.

2. A heat pump system (FIG. 1) comprising a first evaporator (A) receiving input heat to produce relatively high pressure working fluid vapor;

compressor means (SE) having first and second input ports (16, 23) and an output port (18), said first input port coupled to said evaporator (A) to receive said vapor for driving said compressor means, said second input port being adapted to receive relative low pressure working fluid vapor to be compressed;

a first condensor (D) coupled to said outlet port of said compressor means to receive vapor from said outlet port to condense said vapor whereby heat of condensation and liquid working fluid is produced;

means (20) for returning condensed working fluid to said first evaporator (A);

said first evaporator (A), said compressor means (SE), said first condensor (D), and said return means (20) being connected in series to form a first working fluid loop;

a generator (E) comprising an absorbent for said working fluid and receiving input heat to expel working fluid vapor from absorbent relatively rich in working fluid to produce working fluid vapor and absorbent relatively depleted of working fluid;

a second condensor (F) coupled to receive said expelled working fluid vapor to condense it, whereby heat of condensation is produced;

pressure reducing means;

a second evaporator (H) receiving input heat and coupled to said second condensor (F) through said pressure reducing means to receive and evaporate said condensed working fluid;

an absorber (G) coupled to receive said evaporated working fluid vapor from said second evaporator, and said relatively depleted absorbent from said generator (E) to produce absorbent relatively rich in working fluid, and heat of absorption, and means to return said relatively rich absorbent to said generator; said generator, said second condensor, said pressure reducing means, said second evaporator, said absorber and said return means being connected in series to form a second working fluid loop, wherein said first condensor (D) and said generator (E) are thermally coupled to supply said heat of condensation from said first condensor as input heat to said generator.

a working fluid connection (23) between said second condensor (F), and said low pressure inlet of said compressor means, and a second working fluid connection (28) between said first (D) and second (F) condensors.

3. The system as claimed in claim 2 further comprising (FIG. 3A);

a second generator (E);

a third condensor (F);

a working fluid connection between said second generator and said third condensor;

said second generator being connected in the loop between said first generator (C) and said absorber (G),and said third condensor (F) being connected within the loop between said second condensor (B) and said second evaporator (H), and wherein heat coupling means is provided for coupling heat from said second condensor (B) to said second generator (E).

4. The system as claimed in claim 2 further comprising (FIG. 5);

a third evaporator (F) and a second absorber (E), and a working-fluid connection therebetween, said third evaporator being connected within said second loop between said second condensor (B) and said second evaporator (H); said second absorber being connected within said second loop between said generator (C) and said first absorber (G), and further comprising means for coupling heat from said first absorber (G) to said third evaporator (F).

5. A heat pump system including in combination a compressor heat pump circuit comprising evaporator means (A) energized by input heat of a first, relatively high level to produce high pressure working fluid vapor, compressor means (SE) energized by said high pressure working fluid vapor and having a driving input (16) receiving said vapor, a suction input (23), and vapor output, a condensor (D) connected to said output to condense said vapor to produce condensed working fluid and heat of condensation, means (32) for returning working fluid from said condensor to said evaporator, pressure reducing means (29);

a second evaporator (B) connected to said condensor through said pressure reducing means (29) and adapted to receive input heat to produce low pressure working fluid vapor;

means for coupling said suction input of said compressor means to said second evaporator (B); further comprising an absorption heat pump circuit comprising in series to form a closed absorbent heat pump working fluid circulation loop, a generator (E), a second condensor (F), pressure reducing means, an evaporator (H), an absorber (G) and absorbent exchange means and including a thermal coupling between said first condensor (D) and said generator (E) to supply heat of condensation produced in said first condensor (D) as input heat to said generator, and a thermal coupling between said second evaporator (B) and both said second condensor (F) and said absorber (G) to supply heat of condensation from said second condensor (F) and heat of absorption from said absorber (G) to said second evaporator.

6. A heat pump system (FIG. 4) comprising a first evaporator (A) receiving input heat to produce relatively high pressure working fluid vapor;

compressor means (SE) having first and second input ports and an output port, said first input port coupled to said evaporator to receive said vapor for driving said compressor means, said second input port being adapted to receive relatively low pressure working fluid vapor to be compressed;

a first condensor (D) coupled to said outlet port of said compressor means to receive vapor from said outlet port to condense said vapor whereby heat of condensation and liquid working fluid is produced;

means for returning condensed working fluid to said first evaporator (A); said first evaporator, said compressor means, said first condensor and said return means being connected in series to form a first working fluid loop;

further comprising absorbent heat pump means including a generator (C), a second condensor (D) a second evaporator (H) and an absorber (G) coupled in series to form a second working fluid loop;

a third condensor (F) connected in said second loop between said second condensor (B) and said second evaporator (H);

a second generator (E) connected in said second loop between said first generator (C) and said absorber (G);

a working fluid connection (23') from said third condensor (F) to said second input of said compressor means (SE);

first means for coupling heat from said first condensor (D) to said first generator (C), and second means for coupling heat from said second condensor (B) to said second generator (E).

* * * * *